US007063493B2

(12) United States Patent
Pfeiffer et al.

(10) Patent No.: US 7,063,493 B2
(45) Date of Patent: Jun. 20, 2006

(54) SYSTEM AND METHOD FOR HANDLING CONTAINERS OF BULK PARTICULATE MATERIALS

(75) Inventors: John W. Pfeiffer, Hughesville, PA (US); James E. Mothersbaugh, Muncy, PA (US); Anthony Boroch, Montoursville, PA (US)

(73) Assignee: The Young Industries, Inc., Muncy, PA (US)

( * ) Notice: Subject to any disclaimer, the term of this patent is extended or adjusted under 35 U.S.C. 154(b) by 0 days.

(21) Appl. No.: 10/106,191

(22) Filed: Mar. 27, 2002

(65) Prior Publication Data

US 2003/0185659 A1 Oct. 2, 2003

(51) Int. Cl.
*B65D 35/22* (2006.01)

(52) U.S. Cl. ..... 414/412; 222/181.2; 414/626

(58) Field of Classification Search ..... 414/626, 414/412; 222/181.2
See application file for complete search history.

(56) References Cited

U.S. PATENT DOCUMENTS

| | | | | |
|---|---|---|---|---|
| 4,054,161 | A * | 10/1977 | Alack | 141/12 |
| 4,467,845 | A * | 8/1984 | Strand et al. | 141/10 |
| 4,527,716 | A * | 7/1985 | Haas et al. | 222/83.5 |
| 4,953,752 | A * | 9/1990 | Tousignant et al. | 222/23 |
| 4,966,311 | A * | 10/1990 | Taylor | 222/105 |
| 5,033,706 | A * | 7/1991 | Poulton | 248/149 |
| 5,036,893 | A * | 8/1991 | DeCrane | 141/114 |
| 5,069,596 | A * | 12/1991 | Mueller et al. | 414/607 |
| 5,333,757 | A * | 8/1994 | Volk et al. | 222/94 |
| 5,413,154 | A * | 5/1995 | Hurst et al. | 141/83 |
| 5,415,323 | A * | 5/1995 | Fenelon | 222/1 |
| 5,507,237 | A * | 4/1996 | Barrow et al. | 108/55.1 |
| 5,743,515 | A * | 4/1998 | Wodell | 254/334 |
| 5,944,470 | A * | 8/1999 | Bonerb | 414/421 |
| 5,975,351 | A * | 11/1999 | DeLacerda | 222/1 |
| 6,138,443 | A * | 10/2000 | Taylor et al. | 53/492 |
| 6,213,315 | B1 * | 4/2001 | Forney et al. | 211/85.15 |
| 6,227,408 | B1 * | 5/2001 | Poulton | 222/1 |
| 6,318,594 | B1 * | 11/2001 | Hutchins | 222/1 |
| 6,415,909 | B1 * | 7/2002 | Mitchell et al. | 198/716 |

FOREIGN PATENT DOCUMENTS

| | | |
|---|---|---|
| DE | 100 23 507 A 1 | * 11/2001 |
| FR | 2 254 933 | * 11/1975 |
| WO | 97/42078 | * 11/1997 |

* cited by examiner

*Primary Examiner*—Thomas J. Brahan
(74) *Attorney, Agent, or Firm*—Stevens, Davis, Miller & Mosher, LLP

(57) ABSTRACT

A system for unloading a container of bulk particulate material, having attachment means for lifting the container and a spout for discharging material therefrom, generally consisting of an unloading apparatus including a material hopper, a mobile apparatus and a carrier member including an arrangement for detachably connecting a container thereto, an arrangement for detachably mounting on a mobile apparatus and an arrangement for detachably mounting on the unloading apparatus.

37 Claims, 4 Drawing Sheets

SYSTEM AND METHOD FOR HANDLING CONTAINERS OF BULK PARTICULATE MATERIALS

BACKGROUND OF THE INVENTION

This invention relates to the handling of bulk particulate materials and more particularly to a system and method for transporting a container of bulk particulate material from a first site to a second site for unloading.

In many industries utilizing bulk particulate materials such as powders, pellets, granules, grains and the like, such materials often are deposited in large bulk bags for storage and transportation purposes. When such bags are to be transported and/or unloaded into a vessel, conveyor line or a processing apparatus, they must be lifted, moved to the unloading site and then positioned on an unloading apparatus to permit the contents thereof to be discharged. In the prior art, various types of equipment and methods have been used to provide such handling. Typically, forklift trucks, hoists and other lifting equipment and combinations of such equipment have been used for lifting, transporting and positioning such bags for unloading the contents thereof. Such equipment and methods of lifting, transporting and unloading such bags have been found to be comparably cumbersome, inefficient and costly to operate. Therefore, the principal object of the present invention is to provide an improved method and system for lifting, transporting and unloading bags of bulk particulate materials, which is simple, efficient and economical.

SUMMARY OF THE INVENTION

The present invention provides a method for handling containers of bulk particulate material which generally consists of detachably connecting a carrier member to a mobile apparatus, transporting the mobile apparatus to the site of the container to be transported and unloaded, detachably connecting the container to the carrier member mounted on the mobile apparatus, transporting the mobile apparatus with the carrier member and container supported thereon to the site of an unloading apparatus, detachably connecting the carrier member with the container supported thereon to the unloading apparatus, detaching the carrier member with the container supported thereon from the mobile apparatus and then operating the unloading apparatus. Preferably, the carrier member comprises a rigid frame or bracket, the mobile apparatus comprises a forklift truck having a set of vertically displaceable blades insertable into pockets provided in the carrier member for detachably mounting the carrier member on the forklift truck and raising and lowering it, and the unloading apparatus is provided with a hopper into which a discharge spout of a container supported on the unloading apparatus may be inserted for conducting material discharged from the container into another container, a conveying line or a material processing unit. The container may consist of a flexible bulk bag having a set of looped straps which may be connected to hook portions of the carrier member for suspending the container from the carrier member.

DETAILED DESCRIPTION OF AN EMBODIMENT OF THE INVENTION

Figure 1:
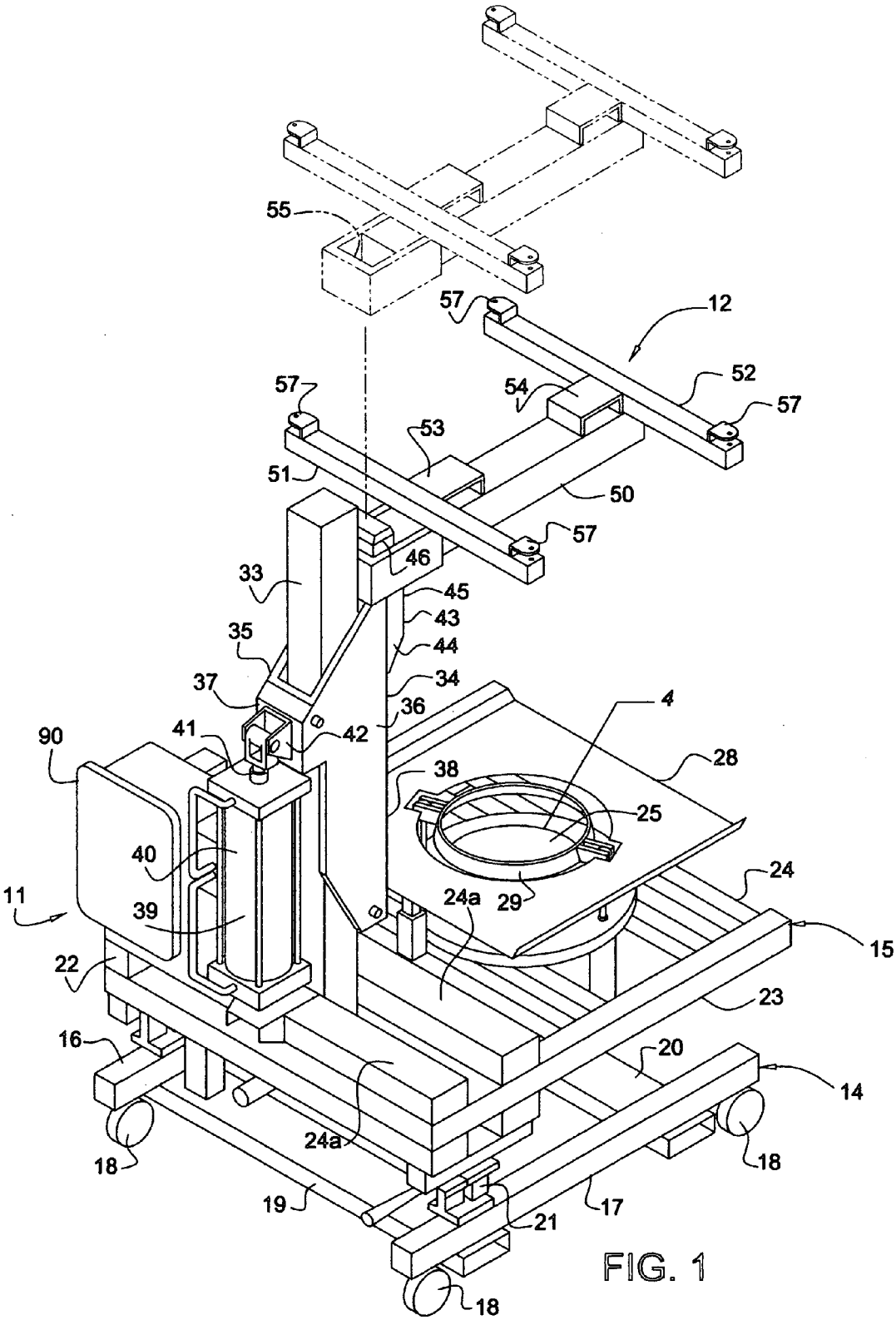
FIG. 1 is a perspective view of an unloading apparatus and a carrier member constituting components of a system for handling containers of bulk particulate material, embodying the present invention, illustrating the carrier member detachably connected to the unloading apparatus in solid lines and the carrier member detached from the unloading apparatus in phantom lines.
Figure 3:
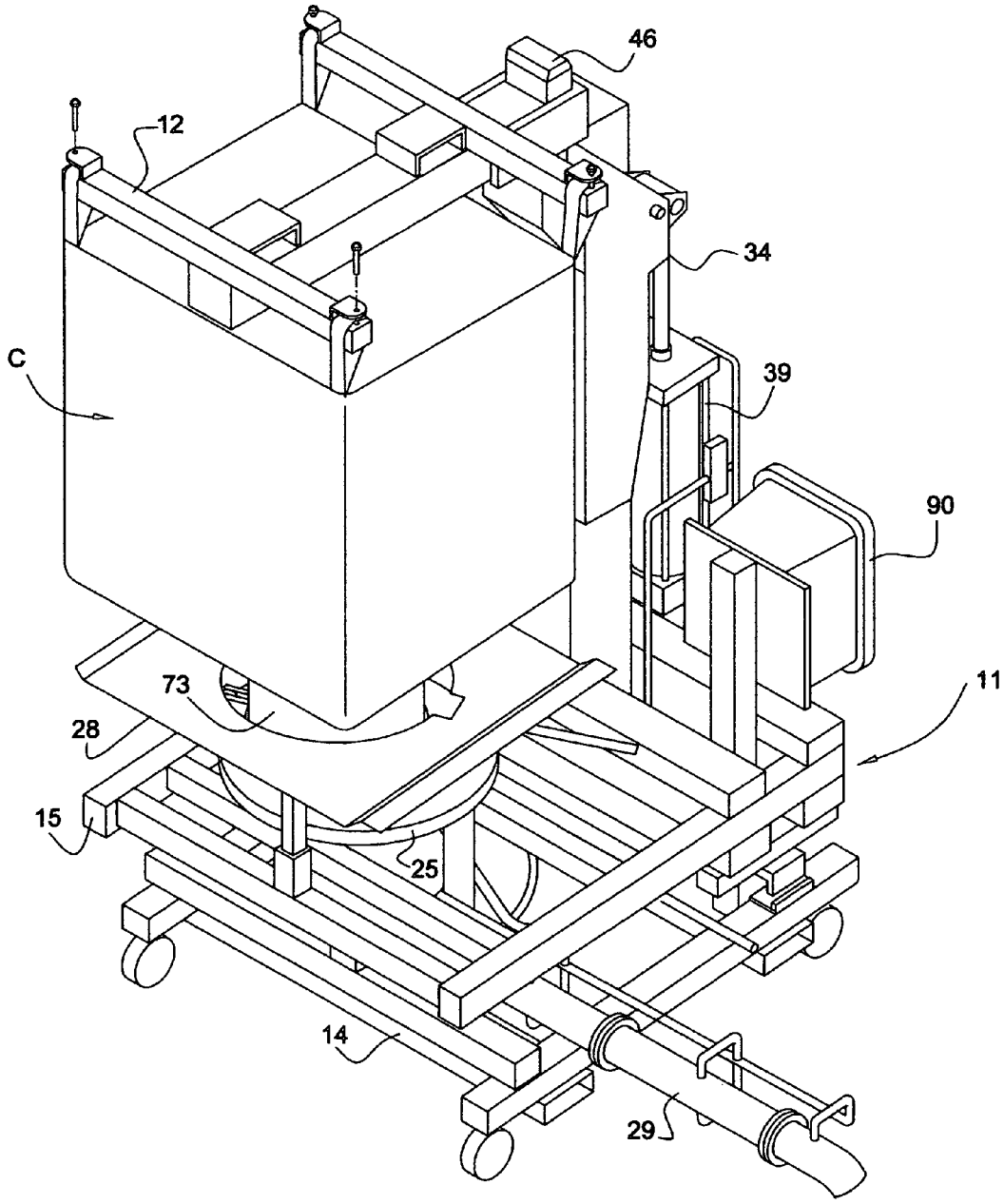
FIG. 3 is a perspective view of the opposite side of the unloading apparatus shown in FIG. 1, further illustrating the carrier member detachably connected to the unloading apparatus, the container suspended from the carrier member and the container further positioned relative to the unloading apparatus for discharging material therefrom into a hopper provided on the unloading apparatus.

Referring to the drawings, there is illustrated a system 10 for transporting and unloading a container C of bulk particulate material. The system generally includes an unloading apparatus 11, a carrier member 12 and a forklift truck 13. As best shown in FIGS. 1 and 3, the unloading apparatus includes a lower base frame 14 and an upper support frame 15. The lower frame includes a pair of spaced box beam members 16 and 17 that may be supported on a set of wheels 18 or on the floor, interconnected by a set of beam members 19 and 20 forming parallel pockets or openings adapted to receive the blades of a forklift truck for relocating the unloading apparatus. Upper support frame 15 is supported on the lower frame. Interposed between the upper and lower frames is a set of load cells 21 enabling the weight of material in a container positioned on the upper frame of the apparatus to be determined. Frame 15 further consists of a pair of spaced box beam members 22 and 23 interconnected by means of a plurality of cross beam members 24 including a set of larger cross beam members 24*a* disposed at one end of the frame.

Mounted on the upper support frame and extending through a spacing between a pair of cross beam members 24 is a material receiving hopper 25 including an upper annular section 26 and a lower conical section 27. The hopper is supported on a spill tray 28 supported on the upper support frame secured to a pair of opposed cross beam members 24. The lower end of conical section 27 is provided with a discharge outlet communicating with a pneumatic conveying line 29 having an end section supported on the lower frame. The conical section of the hopper is provided with a permeable, inner conical wall 27*a* and one or more partition walls cooperating with such conical walls to further provide one or more plenums. Air under pressure is supplied to such plenum or plenums through an inlet 27*b* which is caused to flow through the permeable wall to fluidize material flowing through the hopper and correspondingly enhance such flow. Disposed above and positioned concentrically relative to hopper 25 is an annular support member 29 and a cinch supported on the upper support frame.

Also mounted on the upper support frame, displaced substantially radially from the vertical axis of hopper 25, is a column member 33 provided with a slide member 34 displaceable along an upper portion thereof. The column member has a substantially rectangular cross-sectional configuration and is rigidly mounted at its lower end on the upper support frame. The slide member includes a pair of side walls 35 and 36 alongside the side walls of the column member, and a set of end walls 37 and 38 spaced from a set of walls of the column member. Mounted on the inner sides of wall members 37 and 38 and engaging the column member is a set of blocks or rollers for facilitating the displacement of the slide member along the upper portion of the column member. The slide member is displaced vertically relative to the column member by means of a fluid actuated cylinder assembly 39 including a cylinder member 40 disposed vertically and rigidly seated at its lower end on the upper support frame adjacent the lower end of the column member, and a rod member 41 having the end thereof connected to a bracket 42 rigidly mounted to end wall 37 of the slide member.

Mounted on end wall 38 of the slide member is a connecting bracket 43 consisting of a pair of side walls 44, 44 and an end wall 45, housing an upwardly projecting member 46.

Carrier member 12 also is best illustrated in FIGS. 1 and 3. Generally, it consists of a base beam section 50 and a pair of spaced, parallel cross beam sections 51 and 52 mounted on and rigidly secured to an upper side of beam section 50. Also mounted on and rigidly secured on the upper side of beam section 50 is a pair of channel-shaped sections 53 and 54 providing a pair of spaced pockets or slots adapted to receive a pair of blades of a forklift truck for detachably connecting the carrier member to the forklift truck. Beam section 50 further is provided with a slot 55 at one end thereof which is adapted to receive upwardly projecting member 46 to detachably connect the carrier member to slide member 34. The upper edges of member 46 are leveled to facilitate the receipt of member 46 into slot 55. Upon receipt of member 46 within slot 55, the side walls of the projecting portion of beam 50 are adapted to seat on side walls 44, 44 of bracket 43 and the upper ends of side walls 35 and 36 of slide 34.

The ends of cross beam sections 51 and 52 are provided with a set of L-shaped hook portions 57 onto which looped straps of a container C may be connected to suspend such container from the carrier member. The upper ends of the straps are intended to be inserted between the ends of beams 51 and 52 and hook portions 57 and secured therein by a set of retaining pins. Other means for connecting such straps to the carrier member also may be used.

The unloading apparatus and the carrier member are designed and dimensioned so that when the carrier member is mounted on the unloading apparatus as shown in FIG. 1, beam section 50 of the carrier member will be disposed substantially diametrically relative to the vertical axis of hopper 25, the axis of hopper 25 will extend substantially through the center of beam section 50 and hooks 57 each will be disposed equidistantly relative to the extended axis of hopper 25.

The third component of the system is a mobile apparatus consisting of a conventional forklift truck. The truck includes a chassis 61 mounted on a set of wheels and supporting a motor, a mast 62 and an operator's station. Mounted on the mast and displaceable vertically thereon is a fork assembly 63 having a set of laterally spaced, parallel blades 64 adapted to be inserted into the pockets or slots provided on beam sections 19 and 20 of the unloading apparatus for repositioning such apparatus, and also in the pockets or slots provided by channel-shaped portions 53 and 54 of the carrier member for detachably connecting the carrier member to the fork assembly of the tractor.

Figure 2B:
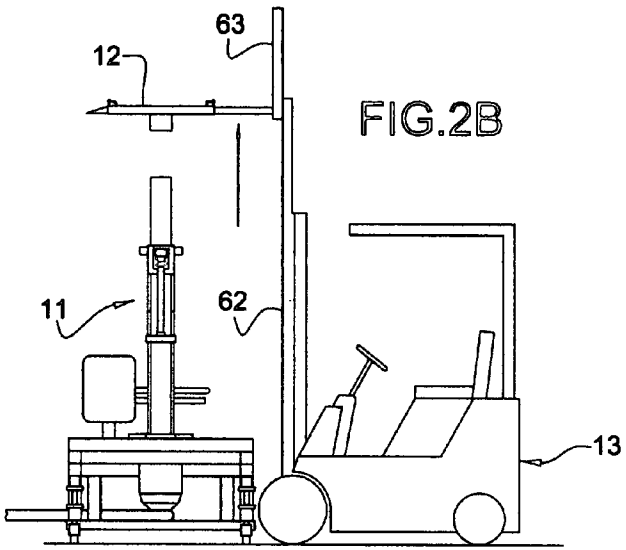
FIGS. 2A through 2G illustrate the sequence of use of the system embodying the present invention including the carrier member and unloading apparatus shown in FIG. 1, further illustrating the positions of the components thereof in transporting a container of bulk particulate material from a storage site to the site of an unloading apparatus, positioning the container on the unloading apparatus and operating the unloading apparatus to discharge the material from the container.
Figure 2D:
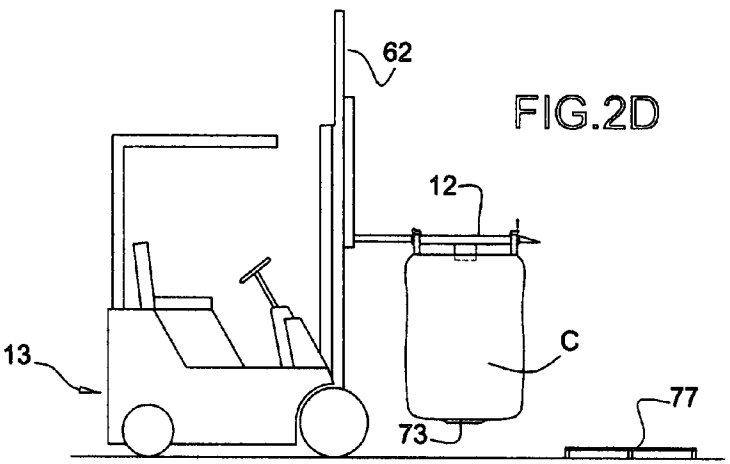
Figure 2A:
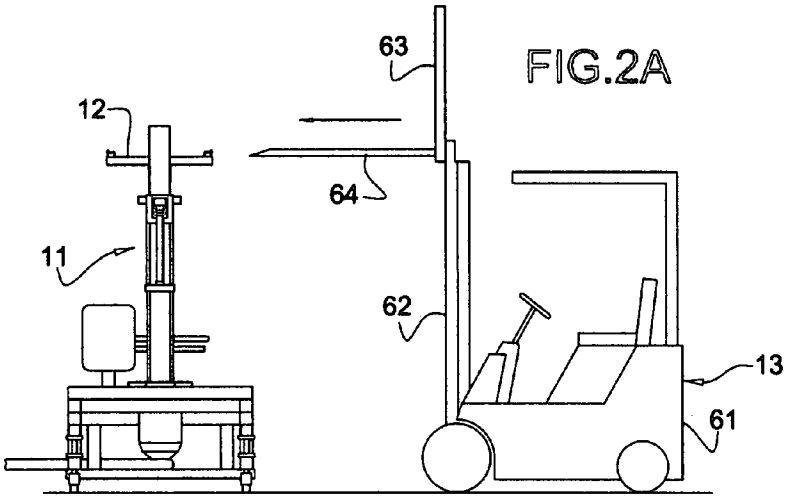
Figure 2C:
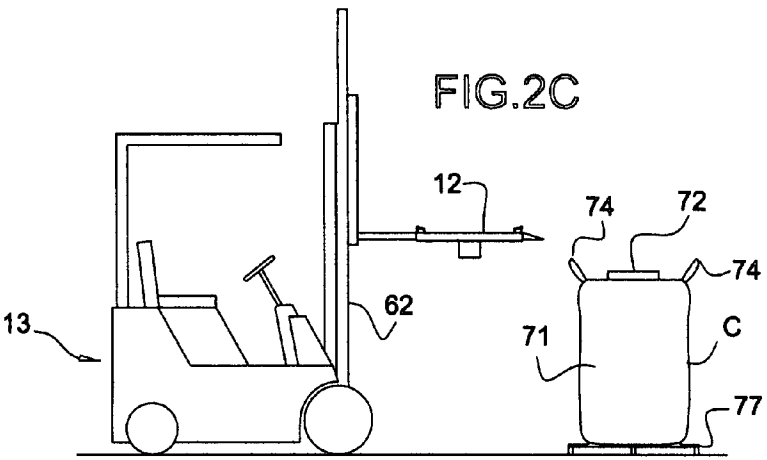

As best seen in FIGS. 2C and 2D, container C consists of an enclosure 71 formed of a flexible, high strength material, having an upper, foldable neck portion 72 and a lower, foldable spout portion 73. The neck portion may be expanded to provide an inlet for depositing bulk particulate material into the container, and then collapsed to close such opening. The spout section similarly may be expanded to form a discharge outlet, and collapsed or cinched to close such outlet. The upper end of the container further is provided with a set of looped straps 74 for suspending the container when transporting it. As shown in FIG. 2C, such containers are adapted to be supported on a pallet 77. The neck portion of the container may be opened beneath a device provided with a valve for gravity feeding bulk particulate material into the container.

In the use of the system as described for transporting a container C supported on a stationary frame 75, as shown in FIG. 2C, to an unloading apparatus 11 as shown in FIGS. 1 and 3, positioning the container on the unloading apparatus and unloading the contents of the container into conveying line 29, tractor 13 is first positioned adjacent the unloading apparatus and fork assembly 63 is operated to aligned blades 64 with the pockets of portions 53 and 54 of the carrier member normally mounted on the unloading apparatus as shown in FIGS. 1 and 2A. With the blades thus aligned, the tractor is advanced to insert the blades of the fork assembly into the pockets of the carrier member. The fork assembly of the tractor is then raised to lift the carrier assembly free of the unloading apparatus as shown in FIG. 2B. With the carrier member thus mounted on the blades of the fork assembly of the tractor, the tractor is then maneuvered to a position adjacent a container C, and the fork assembly is lowered to position the carrier member at a level just above the upper end of the container as shown in FIG. 2C. The tractor is then advanced to position the carrier member above the container. Straps 74 of the container are then attached to hooks 57 of the carrier member.

Figure 2E:
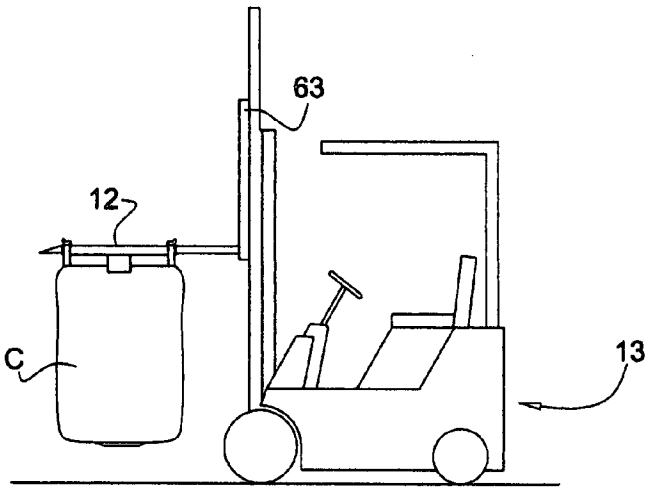
Figure 2G:
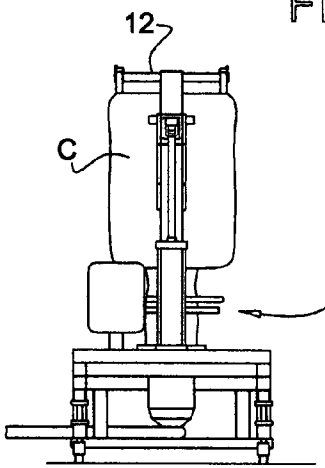
Figure 2F:
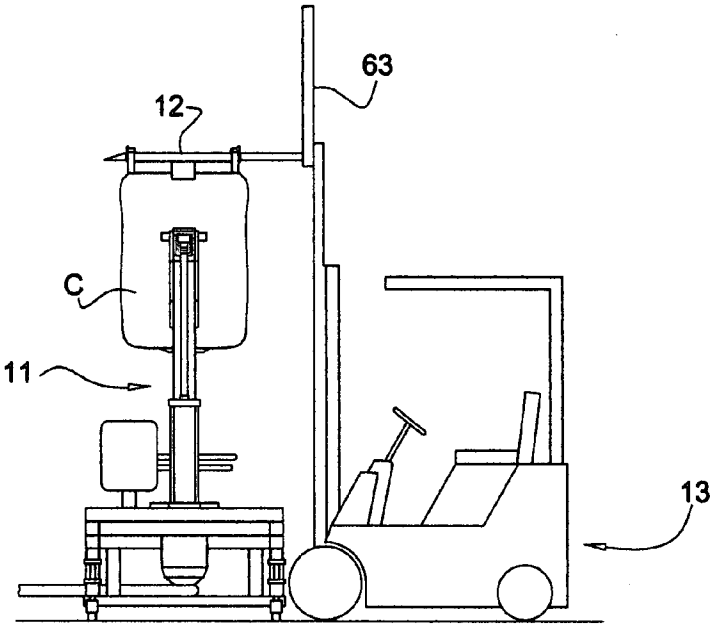
Figure 4:
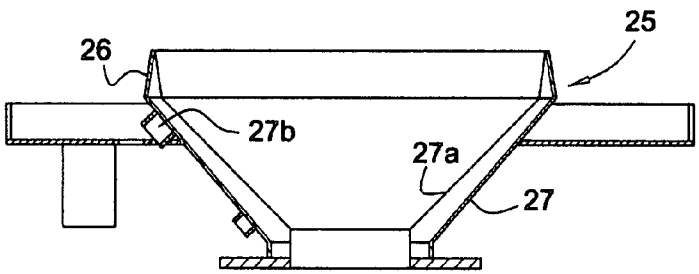
FIG. 4 is an enlarged, vertical cross-sectional view of the hopper provided in the unloading apparatus shown in FIGS. 1 and 3.

With the neck and spout portions of the container folded closed, collapsed and secured in their closed positions, the tractor may be backed away from the pallet to a position as shown in FIG. 2D. The container thus mounted on the fork assembly of the tractor may then be transported as shown in FIG. 2E to a position over the upper support frame of the unloading apparatus with slot 55 of the carrier member vertically aligned with projecting member 46 of bracket 43, and the vertical centerline of the container aligned with hopper 25, as shown in FIG. 2F. The fork assembly of the tractor is then lowered to receive member 46 of slide member 34 in slot 55 of the carrier member. Prior to connecting the carrier member to the slide member, cylinder assembly 39 may be operated to lift the slide member and thus permit the container suspended from the carrier member to clear the upper end of hopper 25 and annular member 29. The blades of the fork assembly then are removed from the carrier member by backing off the tractor, and cylinder assembly 39 may be operated to position the container as shown in FIGS. 2G and 3, partially supported an annular support member 29. The spout may remain closed until the time that the container is to be unloaded. The spout also may be unfolded, untied and closed with a cinch. The cinch may then be opened and closed as desired to meter the flow of material into the hopper. Any material diverted from the hopper will deposit on the spill tray from which it may be recovered.

When the container is positioned on the unloading apparatus as shown in FIGS. 2G and 3, the lower end is partially seated and thus supported on annular member 29 although the major portion of the load is carried by the carrier member mounted on the upper end of the column member. The carrier member may be locked in position on bracket 43 of the slide member by means of a pin insertable in registered openings in bracket 43 and the projecting portion of the carrier member when member 46 is received within slot 55 with the projection portion of beam 50 seated on bracket 46. Once the container has been positioned on the unloading apparatus, the tractor can be backed off and used for other purposes.

As soon as it is desired to remove an empty or perhaps partially filled container, the cylinder assembly is operated to lift the container and thus allow the sprout to be closed, the carrier member is raised further to free the container from the hopper and the procedure as previously described may be reversed to cause the tractor to connect to the carrier member to detach the carrier member from the unloading apparatus, transport the carrier member with the attached container to an area as shown in FIGS. 2C and 2D and then to position the container on a pallet.

Also mounted on the lower support frame is a control box 90 containing electrical controls for operating the cylinder assembly and supplying air under pressure to the hopper for fluidizing material flowing through the hopper.

The unloading apparatus may be mobile as shown in FIG. 1 or stationary. In the mobile mode, it may be transported either on wheels 18 or by means of the forklift tractor. Although a pneumatic conveying line is provided in the embodiment described into which the contents of a container positioned on the unloading apparatus may be discharged, such material may be discharged into any other form of receptacle including a vessel, another container, a processing unit, a mechanical conveyer and the like. It is further contemplated that the unloading apparatus and carrier be formed of welded metal plate and bar stock, and designed and dimensioned to accommodate commercially available forklift tractors.

Other means may be utilized within the scope of the invention to detachably connect the carrier member to the column or mast of the unloading apparatus. As an example, the slide may be formed with a slot and the carrier may be formed with a depending leg portion which may be inserted into such slot. Although any male and female type of connection can be used, it is preferred that the female portion of the connecting parts be provided on the carrier because it facilitates the manufacture of the carrier member, facilitates the connection of the carrier member to the column of the unloading apparatus, allows the carrier member to lie flat on the floor for storage and other purposes without a depending leg portion and avoids any interference with a bag being attached, carried or detached as a depending leg portion may cause.

The unique designs of the unloading apparatus and the carrier member, the use of such a carrier member detachably connectable to a conventional forklift truck and an unloading apparatus for supporting containers, and the use of commercially available forklift trucks render the described system and method simple, efficient and economical in use.

From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

We claim:

1. A system for unloading a container of bulk particulate material, having attachment means at an upper end thereof for supporting said container in suspended relation, and a spout at a bottom end thereof for discharaing material therefrom comprising:

an unloading apparatus including a support frame, a hopper mounted on said support frame and a single column mounted on said support frame and displaced laterally relative to said hopper;

a mobile apparatus; and a carrier member having means for detachably connecting said container thereto in suspended relation, therewith, means for detachably mounting on said mobile apparatus and means for detachably mounting on said column in cantilever relation thereto, said carrier member having connecting means positioned so that upon detachably mounting said carrier member on said column, the spout of said container will be aligned with said hopper including a slide member mounted on said column, displaceable along a portion of the length thereof, means disposed on said slide member for detachably connecting said carrier member, and means operatively interconnecting said frame and said slide member for displacing said slide member along said column.

2. A system according to claim 1 wherein said frame is supported on a set of wheels.

3. A system according to claim 1 wherein said frame includes a lower frame section, an upper frame section and at least one load cell disposed therebetween.

4. A system according to claim 1 wherein said frame is provided with at least one annular member for guiding said container spout into said receiving hopper.

5. A system according to claim 1 wherein said column includes a projecting member and said carrier member includes an opening in which said projecting member is insertable for detachably connecting said carrier member to said unloading apparatus.

6. A system according to claim 5 including means for releasably locking said carrier to said column.

7. A system according to claim 1 wherein said displacing means comprises a fluid actuated cylinder assembly.

8. A system according to claim 1 wherein said slide member includes a projecting member and said carrier member includes a slot in which said projecting member is receivable for detachably connecting said carrier member to said unloading apparatus.

9. A system according to claim 8 wherein said displacing means comprises a fluid actuated cylinder assembly.

10. A system according to claim 1 wherein said hopper includes a discharge outlet communicable with a pneumatic conveying line.

11. A system according to claim 10 wherein said hopper includes means for inducing the gravity flow of material through said spout when said container is mounted on said unloading apparatus and said spout is positioned to feed material into said hopper.

12. A system according to claim 11 wherein said flow inducing means comprises means for fluidizing the inner sides of the walls of said hopper.

13. A system according to claim 1 wherein said unloading apparatus includes means for cinching said container spout when said container is supported on said unloading apparatus and said spout is positioned to discharge material into said hopper.

14. A system according to claim 1 wherein said mobile apparatus includes a pair of spaced blades and said carrier member includes a pair of spaced slots in which said spaced blades may be received for detachably mounting said carrier on said mobile apparatus.

15. A system according to claim 1 wherein said carrier member includes a set of hooks on which looped straps of said container may be secured for detachably connecting said container to said carrier member and permitting it to be lifted.

16. A system according to claim 1 wherein said mobile apparatus includes a pair of spaced blades and said carrier member includes an elongated beam, a pair of channel beam sections mounted on said elongated beam providing a pair of spaced slots for receiving said spaced blades to detachably mount said carrier member on said mobile means, a pair of cross beams rigidly mounted on said elongated beam and a set of hooks disposed on said cross beams on which looped straps of said container may be secured for detachably connecting said container to said carrier member.

17. A system according to claim 16 wherein said unloading apparatus includes a projecting member and said elongated beam of said carrier member includes an opening in which said projecting member is receivable for detachably connecting said carrier member to said unloading apparatus.

18. A system according to claim 16 wherein said elongated and cross beams comprises box beams.

19. A system according to claim 1 wherein said mobile apparatus includes means for displacing said carrier member vertically when said carrier member is detachably mounted on said mobile apparatus.

20. A system according to claim 1 wherein said mobile apparatus comprises a forklift truck.

21. A system according to claim 17 wherein said unloading apparatus includes a vertically disposed, upwardly projecting member, said projecting member is receivable in said opening for detachably mounting said carrier member on said unloading apparatus and said carrier member includes a surface seatable on said unloading apparatus when said projecting member is received in said opening.

22. A system according to claim 1 wherein said means for detachably connecting said carrier member on said unloading apparatus comprises a male and female type of connection.

23. A system according to claim 22 wherein the female portion of said connection is provided on said carrier member.

24. A system according to claim 23 wherein said female portion is disposed laterally relative to a main body portion of said carrier member.

25. An apparatus for unloading a container detachably connected to a carrier member, holding a bulk particulate material and having a discharge spout, comprising:

a support means a hopper mounted on said support means; and a single column mounted on said support means and displaced laterally relative to said hopper, having means for detachably connecting said carrier member thereon, disposed in cantilevered relation therewith including a slide member mounted on said column, displaceable along a portion of the length thereof, means disposed on said slide member for detachably connecting said carrier member, and means operatively interconnecting said support means and said slide member or displacing said slide member along said column.

26. An apparatus according to claim 25 wherein said support means is supported on a set of wheels.

27. An apparatus according to claim 25 wherein said support means includes a lower frame, an upper frame and at least one load cell disposed therebetween.

28. An apparatus according to claim 25 wherein said support means is provided with at least one annular member for guiding said container spout into said hopper.

29. An apparatus according to claim 25 wherein said column includes a projecting member receivable in an opening of said carrier member for detachably connecting said carrier member to said unloading apparatus.

30. An apparatus according to claim 29 including means for releaseably locking said carrier member on said column.

31. An apparatus according to claim 25 wherein said displacing means comprises a fluid actuated cylinder assembly.

32. An apparatus according to claim 25 wherein said slide member includes a projecting member receivable in an opening in said carrier member for detachably connecting said carrier member to said unloading apparatus.

33. An apparatus according to claim 32 wherein said displacing means comprises a fluid actuated cylinder assembly.

34. An apparatus according to claim 25 wherein said hopper includes a discharge outlet communicable with a pneumatic conveying line.

35. An apparatus according to claim 25 wherein said hopper includes means for inducing the gravity flow of material through said spout when said container is mounted thereon and said spout is positioned to feed material in said hopper.

36. An apparatus according to claim 35 wherein said flow inducing means comprises means for aerating the inner sides of the wall of said hopper.

37. An apparatus according to claim 25 including means disposed thereon for cinching said discharge spout when a container is supported thereon and said spout is positioned to discharge material into said hopper.

* * * * *